United States Patent [19]

Stemmle

[11] Patent Number: 4,712,785

[45] Date of Patent: Dec. 15, 1987

[54] SHEET STACKING APPARATUS

[75] Inventor: Denis J. Stemmle, Webster, N.Y.

[73] Assignee: Xerox Corporation, Stamford, Conn.

[21] Appl. No.: 850,452

[22] Filed: Apr. 11, 1986

[30] Foreign Application Priority Data

Apr. 12, 1985 [GB] United Kingdom ..... 8509462
Apr. 23, 1985 [GB] United Kingdom ..... 8510275

[51] Int. Cl.[4] ..... B65H 29/00

[52] U.S. Cl. ..... 271/187; 271/291; 271/315

[58] Field of Search ..... 271/187, 315, 291, 186; 355/23, 24, 14 SH

[56] References Cited

U.S. PATENT DOCUMENTS

| | | | |
|---|---|---|---|
| 3,851,872 | 12/1974 | Gerbasi | 271/291 |
| 4,073,585 | 2/1978 | Kobayashi et al. | 355/14 |
| 4,234,180 | 11/1980 | Looney | 271/3.1 |
| 4,252,309 | 2/1981 | Garrison et al. | 271/186 |
| 4,431,177 | 2/1984 | Beery et al. | 271/186 |
| 4,436,301 | 3/1984 | Doery et al. | 271/177 |
| 4,466,607 | 8/1984 | Clark et al. | 271/225 |
| 4,506,882 | 3/1985 | Ito | 271/315 X |
| 4,548,402 | 10/1985 | Namba | 271/290 |
| 4,553,828 | 11/1985 | Burger et al. | 355/3 BE |
| 4,579,326 | 4/1986 | Pickney et al. | 271/3.1 |

FOREIGN PATENT DOCUMENTS

| | | |
|---|---|---|
| 1210564 | 10/1970 | United Kingdom . |
| 1464132 | 2/1977 | United Kingdom . |
| 1475094 | 6/1977 | United Kingdom . |
| 1492316 | 11/1977 | United Kingdom . |
| 1566135 | 4/1980 | United Kingdom . |
| 2082550A | 3/1982 | United Kingdom . |

*Primary Examiner*—Richard A. Shacher
*Attorney, Agent, or Firm*—William A. Henry, II

[57] ABSTRACT

Sheet stacking apparatus for handing simplex and duplex copy sheets has both inverting and non-inverting copy sheet paths (6a, 6b) which can be selected by moving a diverter (7) between two positions. In one position (7a) the copy sheet is directed along guide branch (6a) into slots (9) of the disc inverter (8) which rotates to invert the sheet. The sheet is advanced by nip rolls (32a, 32b) at the output end of the inverting path (6a). An upwardly inclined collection tray (10) has a backstop (30) located in the path of the inverted sheet, but with recesses (20) which allow the discs (8) to pass freely. The lead edge of the sheet is brought to rest when it abuts the backstop (30). Nip rolls (32a, 32b) continue to advance the sheet until its trail edge exits the rolls (32a, 32b) and thus it is delivered into the collection tray (10) inverted. In the other position (7b) the diverter (7) directs the sheets along guide branch (6b) to nip rolls (3a, 3b) which feed the sheet without inversion directly into the tray (10). The discs (8) have concave cut-away portions (18) so as not to foul the non-inverting sheet path (6b). The stacker may be used as a moving-bin sorter in which case the discs (8) have flat sides (28) to prevent fouling the path of movable collection trays, i.e. bins, as they pass by.

11 Claims, 2 Drawing Figures

SHEET STACKING APPARATUS

This invention relates to apparatus for stacking sheets, particularly copy sheets issuing from a zerographic or other copier.

When copying a multi-page document, it is known to feed the pages to the copier in 1-N order. Because the copier usually ejects sheets with copy side up, duplex copy sheets would be correctly collated but simplex copy sheets would be stacked N-1 order from the top, thus necessitating an inversion process to be carried out on the individual sheets of the stack to obtain the desired 1-N sheet order of the original document. It is also known to use a stacker which is bottom fed. In this case simplex copy sheets will be stacked in the desired sheet order ab initio, but duplex copy sheets will have to be inverted for correct collation.

According to the present invention there is provided apparatus for stacking sheets fed seriatim from an inlet for receiving copy sheets exiting a reproduction machine, comprising first and second sets of co-acting driven output roller pairs associated respectively with alternative inverting and noninverting copy sheet paths, two coaxial discs each having an arcuate slot communicating at one end with the disc periphery, and diverter means selectably movable between first and second positions, wherein the first position the diverter means is arranged to direct each sheet issuing from the inlet so that its lead edge enters the slots in the discs, which slots guide the sheet to the first set of output rollers, the discs being adapted to rotate as the sheet is advanced by the first set of output rollers so that the sheet is guided by said slots along a substantially semi-circular path and the sheet is thereby inverted before it exits the slots to be received in a collection tray disposed on the side of the discs opposite said inlet, and in the second position the diverter means directs the lead edge of each sheet issuing from the inlet to the second set of output rollers which feed the sheet without inversion directly into the collection tray.

Stacking apparatus in accordance with the invention provides selectable inverting and non-inverting copy sheet paths and is thus suitable for handling both simplex and duplex copy sheets.

The apparatus preferably comprises abutment means disposed in the path of the inverted copy sheet to arrest the lead edge after the leading portion of the sheet has been inverted by the disc rotation. In this way the leading portion of the sheet is caused to leave the slots as the discs continue to rotate. The abutment means may be formed integrally with the collection tray and may additionally serve as a registration edge for the copy sheets in the tray.

Figure 1:
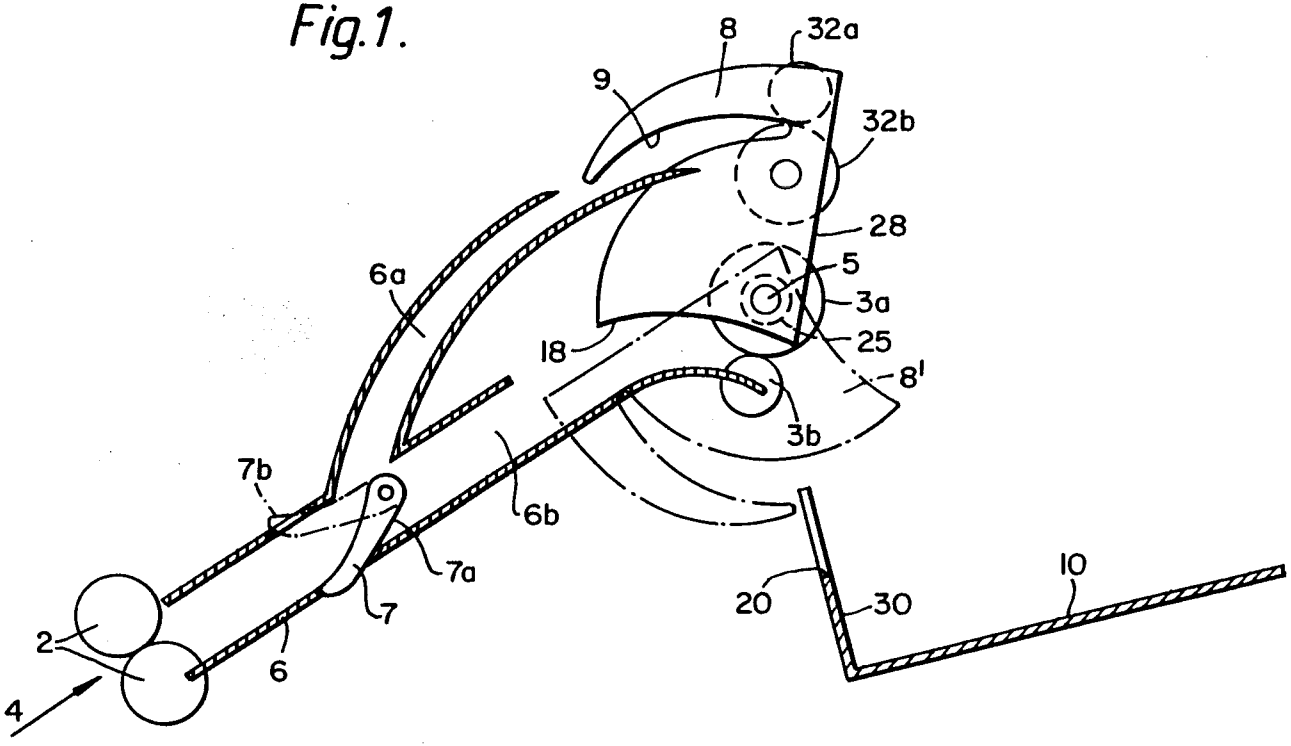
Figure 2:
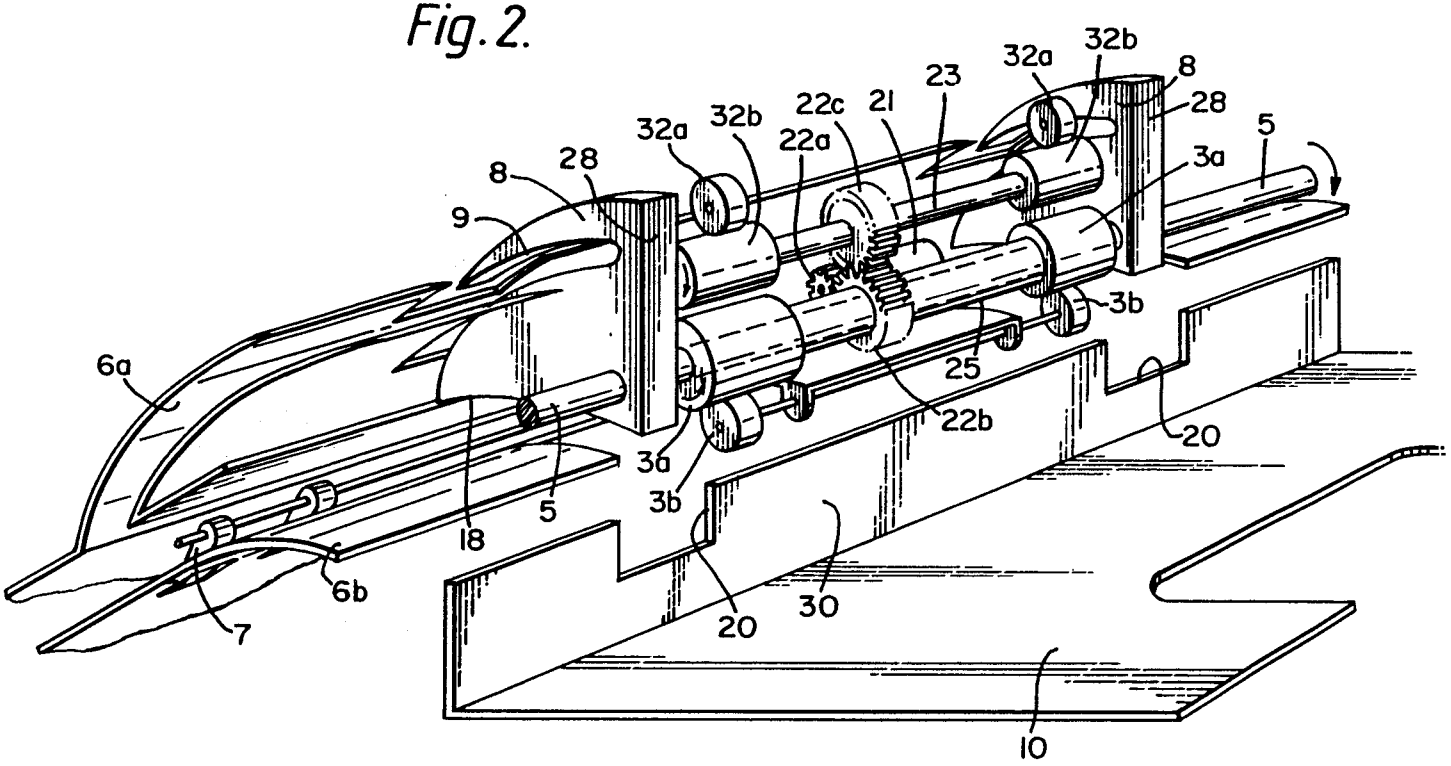

An embodiment of the invention will now be described, by way of example, with reference to the accompanying drawings in which:

FIG. 1 is a schematic sectional view of a sheet-stacking apparatus in accordance with the invention, and FIG. 2 is a perspective view of the sheet-stacking apparatus in FIG. 1.

The sheet stacker shown in the Figures is arranged to receive a copy sheet exiting a photocopier or like machine. The sheet enters through pairs of feed rolls 2 which may form part of the stacker itself or they may be the exit rolls of that part of the machine in which the sheets are processed. The rolls 2 have their nip at the entrance to a curved sheet guide 6 which has branches

6*a* and 6*b* providing alternative copy sheet paths. A diverter gate 7 is selectively movable between two positions 7*a*, 7*b* to direct the copy sheet along one or other of the alternative paths. In the position of the diverter gate 7 shown by a solid line 7*a* in the FIGURE the sheet will be directed along branch 6*a*, whereas in the position shown by the broken line 7*b* the sheet would be directed along branch 6*b*.

Two pairs of nip rolls 3*a*, 3*b* are disposed at the exit of the guide branch 6*b*. Rolls 3*a* are mounted on a shaft 25 which is rotated by drive 21 via gears 22*a*, 22*b*, whereas rolls 3*b* are idlers. The nip rolls 3*a*, 3*b* thus receive the copy sheet diverted along guide branch 6*b* when the diverter gate 7 is in position 7*b* and feed it without inversion directly into a collection tray 10 disposed on the side of the nip rolls 3*a*, 3*b* opposite the inlet rolls 2.

A pair of discs 8 are mounted on a drive shaft 5 about which the drive shaft 25 of rolls 3*a* is journalled. In a suitable arrangement the rolls 3*a* are disposed symmetrically between the two discs 8. Each disc 8 has an arcuate slot 9 which is open at one end to the periphery of the disc and which in one position—as shown by the solid line in the figure—roughly parallel to the exit portion of the lower part of the guide branch 6*a*. In this position the slots 9 communicate with guide branch 6*a* for receiving a copy sheet diverted along branch 6*a* when the diverter gate 7 is in position 7*a*. With the diverter gate 7 in this position the sheet is fed into the slots 9 and as it continues to be advanced by the input rolls 2 it is guided along an arcuate path defined by the boundary edges of the slots 9. The discs 8 may be moving as the sheet enters the slots 9, or they may be triggered into movement as the lead edge of the sheet in the slots approaches the end of the slots.

However, before the lead edge of the sheet abuts the end of the slots 9 it enters pairs of nip rolls 32*a*, 32*b* disposed symetrically between the two discs 8. Rolls 32*b* are mounted on a shaft 23 which is rotated by drive 21 via gears 22*a* and 22*c*. Rolls 32*a* are idlers. The nip rolls 32*a*, 32*b* advance the sheet towards collection tray 10, but at the same time the discs 8 rotate causing the sheet to be guided by the slots 9 along a substantially 180° curved path and the sheet is thus inverted.

The collection tray 10 is upwardly inclined and has at its lower end an upstanding backstop 30 which is disposed in the path of the inverted sheet below the nip rolls 3*a*, 3*b* in such a manner that as the discs continue to rotate the lead edge of the sheet abuts the backstop 30. For short sheets the trailing edge may exit the rolls 3*a*, 3*b* before the leading edge abuts the backstop 30. For longer sheets, however the trailing portion continues to be advanced by nip rolls 32*a*, 32*b*. The backstop 30, which is provided with recesses 20 to allow the free passage of the discs 8, arrests the forward motion of the lead edge of the sheet. Consequently, as the disc continue to rotate past the backstop 30 the lead edge of the sheet exits the slots 9. At the same time nip rolls 32*a*, 32*b* continue to advance the remainder of the sheet until the trailing edge exits the rolls 32*a*, 32*b* and the entire sheet is thus delivered into the tray 10 inverted. The broken line in FIG. 1 represents the position of the disc 8 soon after the lead edge has come into contact with the tray backstop 30. The discs then return to their original or home position shown by solid lines in FIG. 1 ready to receive the lead edge of the next sheet to be stacked.

The stacking process continues with the feeding of successive copy sheets, the discs 8 and rolls 3*a* and 32*a* being rotated continuously or intermittently in timed relation with the introduction of copy sheets.

It can be seen that all the copy sheets delivered to the collection tray 10 will have their lead edges butting against the backstop 30 which thus also serves to register the sheets as they are stacked. If the copy sheets are to be sorted into sets, a plurality of collection trays 10 may be provided which are movable past the output rolls *3a*, *3b* and the discs 8. Thus when a collection tray 10 has received a copy sheet it can be moved, for example vertically, for a different collection tray to receive the subsequent copy sheet. In this case the discs 8 may be suitably shaped by having a flat edge 28 and the movement of the collection trays 10 is timed to occur when the discs 8 will not foul their path as they pass by.

Thus the stacker described here provides alternative inverting and non-inverting sheet paths depending on the selected position of the diverter gate 7, it being noted that in order that the discs 8 in their home position do not foul the sheet path corresponding to the non-inverting guide branch 6a they are provided with concave cut-away portions 18 as shown.

Finally, it will be evident to a person skilled in the art that various modifications may be made to the stacker described above without departing from the scope of the invention defined by the appended claims. For example, it is not necessary to use the tray backstop as an abutment to free the copy sheet from the slots in the discs. Alternatively, the slots may be so designed that when the copy sheet has been inverted and its trail edge has exited the output rolls it is able to slide out from the slots simply under its own weight into a collection tray disposed below.

What is claimed is:

1. Apparatus for stacking sheets fed seriatim from an inlet into a collection tray comprising first and second sets of co-acting driven output roller pairs associated respectively with alternative inverting and non-inverting copy sheet paths, coaxial discs each having an arcuate slot communicating at one end with the disc periphery, and diverter means selectably movable between first and second positions, wherein in the first position the diverter means is arranged to direct each sheet issuing from the inlet so that its lead edge enters the slots in the discs, which slots guide the sheet to the first set of output rollers, the discs being adapted to rotate as the sheet is advanced by the first set of output rollers so that the sheet is guided by said slots along a substantially semi-circular path and the sheet is thereby inverted before it exits the slots to be received inverted in the collection tray, which is disposed on the side of the disc opposite said inlet, and in the second position the diverter means directs the lead edge of each sheet issuing from the inlet to the second set of output rollers which feed the sheet without inversion directly into the collection tray.

2. Apparatus for stacking sheets as claimed in claim 1, comprising abutment means disposed in the path of the inverted sheet to arrest the lead edge after the leading portion of the sheet has been inverted.

3. Apparatus for stacking sheets as claimed in claim 2, wherein the abutment means is disposed in the path of the inverted sheet to arrest the lead edge before the trailing portion of the sheet exits the first set of output rollers whereby the leading portion of the sheet leaves the slots in the discs as the disc continue to rotate.

4. Apparatus for stacking sheets as claimed in claim 3, wherein the abutment means is adapted to allow the free passage of the discs.

5. Apparatus for stacking sheets as claimed in claim 4, wherein the abutment means is formed integrally with the collection tray.

6. Apparatus for stacking sheets as claimed in claim 5, wherein the abutment means also provides a registration edge for the sheets in the collection tray.

7. Apparatus for stacking sheets as claimed in claim 6, wherein the output rollers are disposed intermediate the discs.

8. Apparatus for stacking sheets as claimed in claim 7, wherein the second set of output rollers are driven by a shaft mounted for concentric rotation with the discs.

9. Apparatus for stacking sheets as claimed in claim 8, comprising a plurality of colletion trays movable relative to the discs and output rollers for receiving a respective set of sheets in each tray, said discs being adapted to prevent fouling the path of the collection trays as they move past the discs.

10. Apparatus for stacking sheets as claimed in claim 1, wherein said apparatus is at the outlet of a reproduction machine and is for selectably stacking copy sheets face up or face down.

11. In an apparatus for stacking sheets in a collection tray by feeding the sheets seriatim into a collection tray for stacking therein from a tray inlet at one side of said collection tray with sheet feeding and ejecting means providing a sheet path into said tray through said tray inlet, the improvement comprising:

compact and selectable sheet inverting means positioned directly adjacent said tray inlet at said one side of said collection tray, and selectably actuatable sheet diverter means in said sheet path into said tray and operatively associated with said sheet feeding and ejecting means and said sheet inverting means, said selectably actuatable sheet diverter means being selectably actuatable to either divert selected duplex or simplex sheets into said sheet inverting means or to bypass said sheet inverting means, to allow said sheet feeding and ejecting means to eject said sheets directly into said collection tray without inverting them, said sheet inverting means having means for grasping the leading edge of a sheet diverted therein by said sheet diverter means and rotating in a small radius to flip that sheet over end for end and eject it inverted into said collection tray to provide a selected face up to face down sheet orientation in said collection tray.

* * * * *